United States Patent [19]

Schlomann

[11] 4,228,628

[45] Oct. 21, 1980

[54] BUILDING BLOCKS AND CONNECTOR MEANS THEREFOR

[76] Inventor: Kriemhild Schlomann, Seilerstr. 33, Soltau, Fed. Rep. of Germany, D-3040

[21] Appl. No.: 939,132

[22] Filed: Sep. 1, 1978

Related U.S. Application Data

[63] Continuation of Ser. No. 850,026, Nov. 9, 1977, abandoned.

[30] Foreign Application Priority Data

Nov. 10, 1976 [DE] Fed. Rep. of Germany ..... 2651182

[51] Int. Cl.[2] ..... E04B 2/20

[52] U.S. Cl. ..... 52/438; 52/604; 52/605; 52/606; 52/585

[58] Field of Search ..... 52/585, 586, 562–566, 52/426–428, 437, 438, 442, 505, 605, 606, 607, 712–715, 593, 604, 595, 503

[56] References Cited

U.S. PATENT DOCUMENTS

| | | | |
|---|---|---|---|
| 605,468 | 6/1898 | Bennett | 52/585 |
| 1,087,011 | 2/1914 | Grasso | 52/562 |
| 1,445,901 | 2/1923 | McKee | 52/426 |
| 1,534,454 | 4/1925 | Lewis | 52/428 |
| 1,959,816 | 5/1934 | Crum | 52/438 |
| 1,992,785 | 2/1935 | Steuer | 52/564 |
| 2,061,822 | 11/1936 | Bankert | 52/562 |
| 2,257,001 | 9/1941 | Davis | 52/593 |
| 2,887,869 | 5/1959 | McKay | 52/433 |
| 3,390,502 | 2/1968 | Carroll | 52/585 |

FOREIGN PATENT DOCUMENTS

| | | | |
|---|---|---|---|
| 132346 | 4/1949 | Australia | 52/564 |
| 948169 | 2/1951 | France | 52/564 |
| 1242517 | 8/1960 | France | 52/712 |
| 92910 | 2/1922 | Switzerland | 52/562 |

*Primary Examiner*—James L. Ridgill, Jr.
*Attorney, Agent, or Firm*—Peter K. Kontler

[57] ABSTRACT

There is provided a masonwork which consists of stacked building blocks forming several superimposed horizontal courses. The upper sides of blocks in lower courses and the undersides of blocks in the next-higher courses have registering mirror symmetrical sockets in the form of generally hemispherical cavities for reception of spherical connectors. Auxiliary connectors can be provided to couple neighboring blocks of each course to each other; such auxiliary connectors constitute discrete parts having webs received in aligned channels of the respective blocks and end portions which extend into neighboring sockets or blind bores of such blocks.

24 Claims, 29 Drawing Figures

Fig.13a
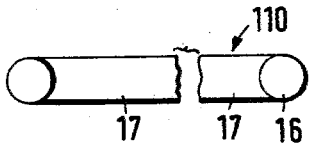
Fig.13
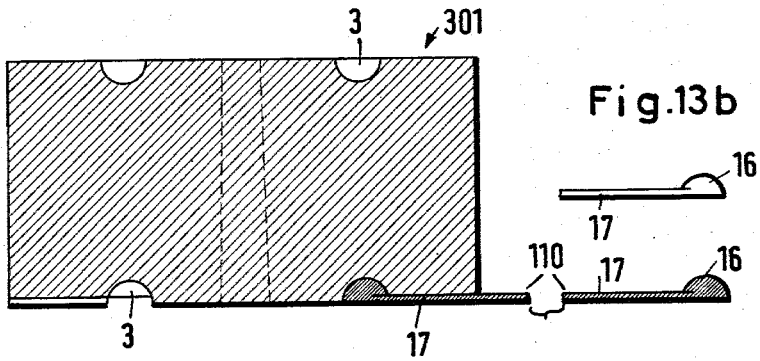
Fig.13b
Fig.14
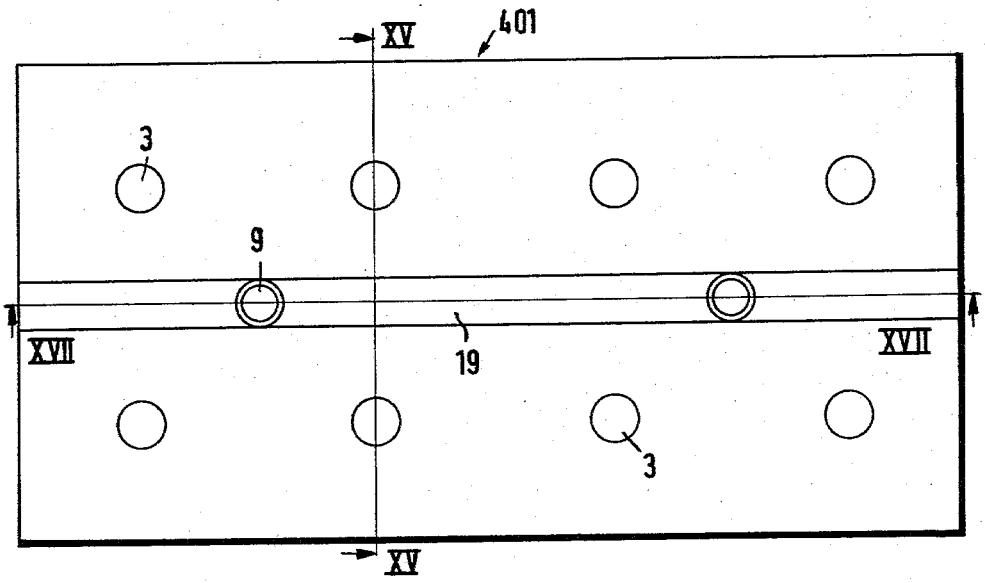

Fig.15
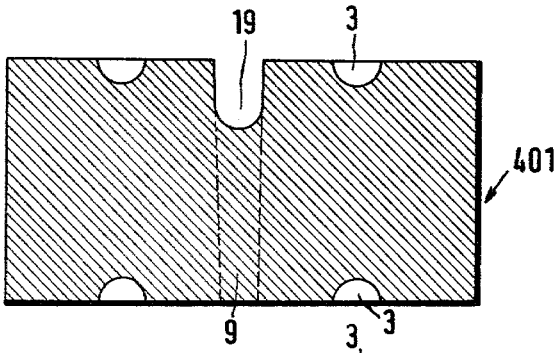
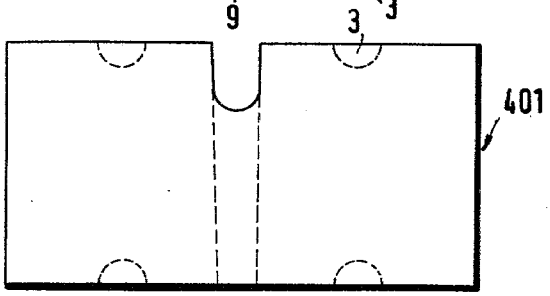
Fig.16
Fig.17
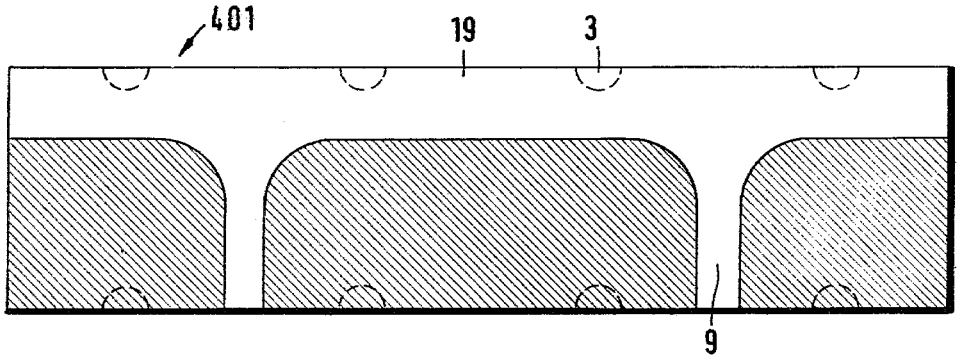

Fig.22
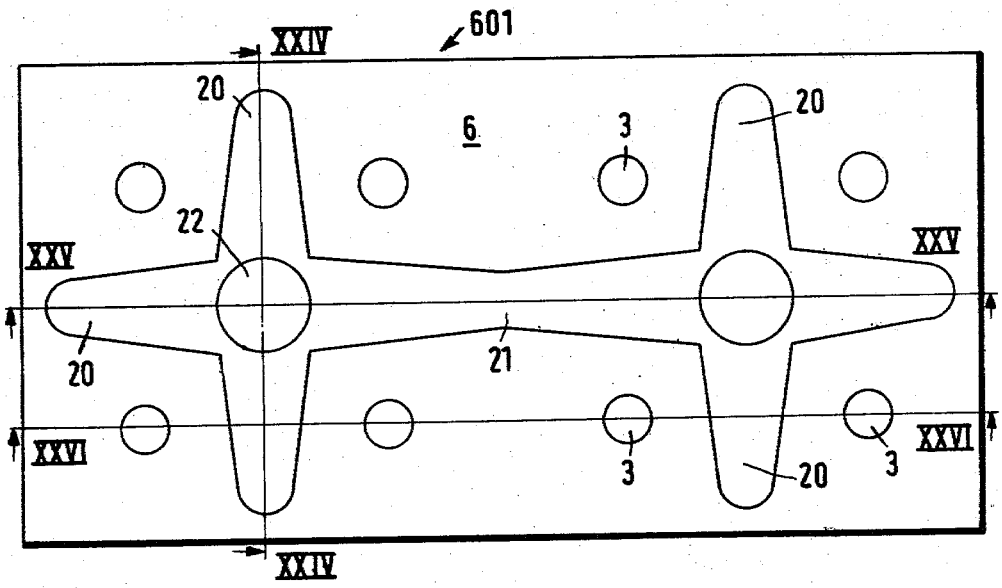
Fig.23
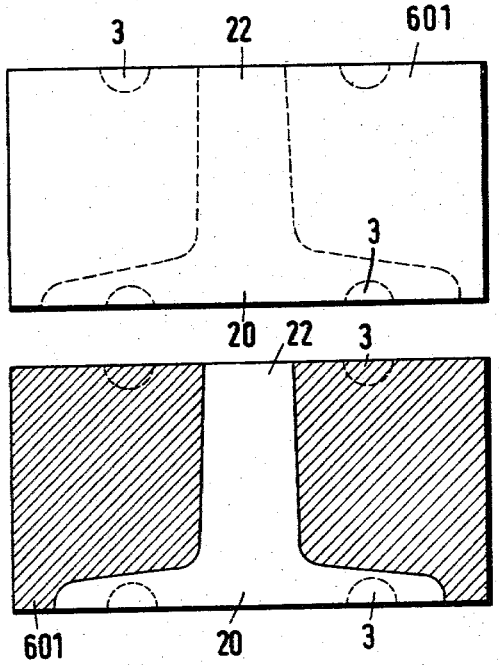
Fig.24

BUILDING BLOCKS AND CONNECTOR MEANS THEREFOR

This is a continuation of application Ser. No. 850,026, filed Nov. 9, 1977, now abandoned.

BACKGROUND OF THE INVENTION

The present invention relates to building blocks in general, and more particularly to improvements in building blocks and in means for connecting neighboring building blocks to each other. The invention also relates to walls or masonworks which can be assembled of improved building blocks and connecting means.

My German patent application Ser. No. P 25 51 507.5, filed Nov. 17, 1975, discloses building blocks which are provided with recesses for reception of plugs or analogous connectors serving to prevent shifting of neighboring blocks relative to each other as well as to enable workmen to accurately stack the blocks on top of each other. Such building blocks render it possible to employ semiskilled or unskilled workers without affecting the quality of the masonwork. Moreover, the building blocks can be assembled with such degree of accuracy that the sides of the resulting masonwork need not be subjected to special treatment in order to enhance its appearance.

The building blocks of the just outlined type can be mass-produced in machines whose construction deviates only negligibly from the construction of machines for the production of conventional building blocks. The additional cost of converting existing machines for the making of building blocks with sockets for reception of suitable connectors is surprisingly low and is clearly warranted in view of the advantages of such building blocks. In fact, the cost of additional tooling which enables a conventional press to make building blocks of the above outlined type is a minute fraction of the cost of the entire machine.

OBJECTS AND SUMMARY OF THE INVENTION

An object of the invention is to provide novel and improved bricks or analogous building blocks and novel and improved connectors for securing neighboring building blocks to each other.

Another object of the invention is to provide building blocks which can be mass-produced at a reasonable cost and can be coupled to each other by means other than masonry joints in such a way that the resulting masonwork is capable of withstanding not only relatively small but also extremely high stresses which tend to move the neighboring blocks laterally or otherwise with respect to each other.

A further object of the invention is to provide novel and improved building blocks which are designed to be keyed together, when stacked or placed end-to-end or side-by-side, so as to resist lateral movement.

An additional object of the invention is to provide a masonwork which embodies building blocks and connectors of the above outlined character, which can be assembled within surprisingly short periods of time, which is of eye-pleasing appearance even if its exposed sides are not coated with plaster or the like, and which is sufficiently inexpensive to warrant its utilization not only in industrialized but also in developing countries.

A further object of the invention is to provide building blocks which, in addition to their primary purpose of forming a wall or the like, can also perform several additional important and useful functions, such as providing space for the laying of cables or pipes, for the introduction of reinforcements and/or for the making of masonry joints subsequent to assembly of two, three or more courses of building blocks.

An ancillary object of the invention is to provide building blocks and connectors which can be properly assembled even in the presence of substantial amounts of dust, fragments of building blocks or other foreign matter in or between neighboring blocks.

Another object of the invention is to provide building blocks and connectors therefor which can be assembled into walls or the like by resorting to semiskilled or unskilled labor, which can be properly assembled without resorting to levels or other instruments or implements, and which can be assembled into a large variety of different eye-pleasing patterns.

One feature of the invention resides in the provision of a masonwork (e.g., an upright wall) which comprises a first and a superimposed second building block (e.g., a brick). The blocks have neighboring surfaces which at least partially overlap each other and are provided with preferably mirror symmetrical registering sockets. A preferably spherical connector has sections or halves which extend into the sockets to thereby hold the blocks against lateral movement relative to each other. The maximum cross-sectional area of the connector is preferably located in the region of the aforementioned surfaces of the blocks. Each socket may be bounded by a hemispherical surface.

The novel features which are considered as characteristic of the invention are set forth in particular in the appended claims. The improved building blocks and connectors themselves, however, both as to their construction and the mode of assembling the same, together with additional features and advantages thereof, will be best understood upon perusal of the following detailed description of certain specific embodiments with reference to the accompanying drawing.

BRIEF DESCRIPTION OF THE DRAWING

FIG. 13 is a sectional view as seen in the direction of arrows from the line XIII—XIII of FIG. 12;

FIG. 13*a* is a fragmentary plan view of the modified auxiliary connector;

FIG. 13*b* is a fragmentary side elevational view of the modified auxiliary connector;

FIG. 14 is a plan view of a building block which is provided with a groove for a pipe, cable or reinforcing material;

FIG. 15 is a sectional view as seen in the direction of arrows from the line XV—XV of FIG. 14;

FIG. 16 is a side elevational view as seen from the right-hand side of FIG. 14;

FIG. 17 is a sectional view as seen in the direction of arrows from the line XVII—XVII of FIG. 14;

FIG. 22 is a bottom plan view of the building block of FIG. 21;

FIG. 23 is a side elevational view as seen from the right-hand side of FIG. 21;

FIG. 24 is a sectional view as seen in the direction of arrows from the line XXIV—XXIV of FIG. 21;

DESCRIPTION OF THE PREFERRED EMBODIMENTS

Figure 1:
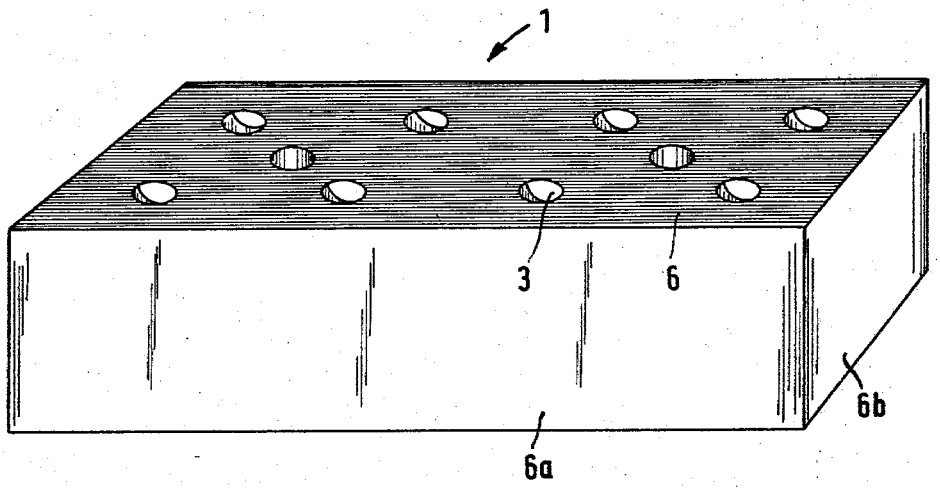
FIG. 1 is a perspective view of a building block which is constructed in accordance with one embodiment of the invention.
Figure 2:
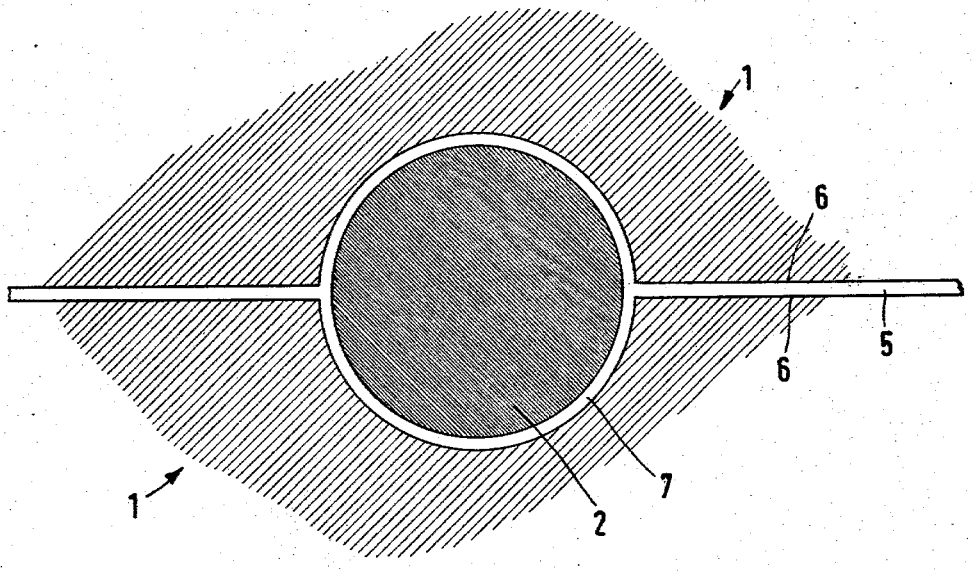
FIG. 2 is a fragmentary vertical sectional view of two superimposed building blocks with a spherical connector therebetween.
Figure 9:
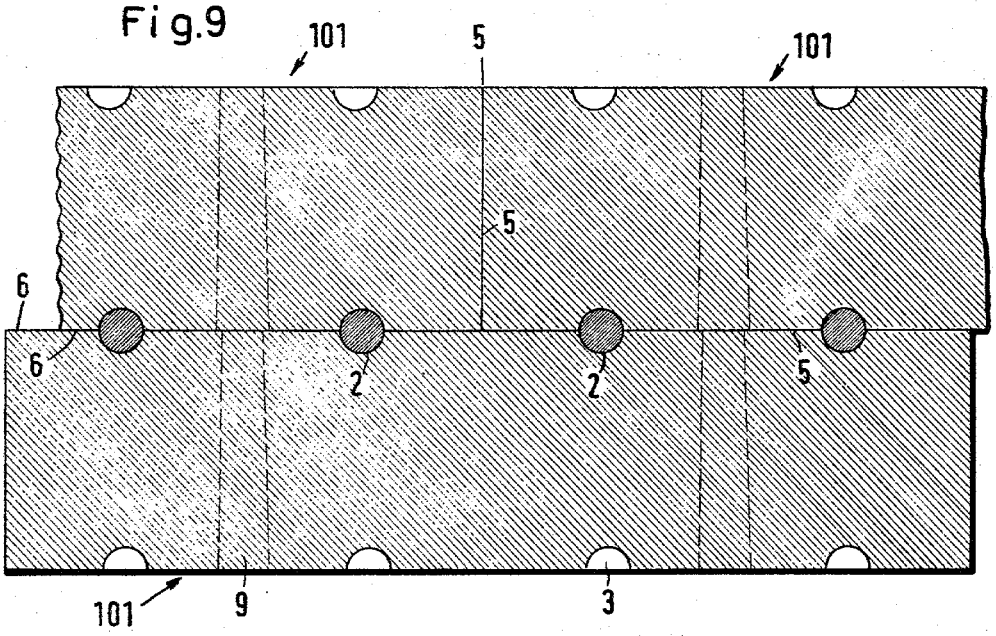
FIG. 9 is a longitudinal vertical sectional view of two courses of a masonwork utilizing building blocks of the type shown in FIGS. 4 to 8.

The brick-shaped building block 1 of FIG. 1 can be assembled with similar or identical building blocks to form a masonwork similar to that shown in FIG. 9. The two major surfaces 6 (only one shown) of the building block 1 are formed with suitably distributed hemispherical cavities or sockets 3 for the corresponding sections or halves of spherical connectors 2 (see FIG. 2 which shows two superimposed building blocks 1 of the type illustrated in FIG. 1). The sockets 3 in each major surface 6 of the building block 1 form two parallel rows, as considered in the longitudinal direction of the building block, or four parallel rows, as considered transversely of the building block. The distance between each socket 3 and the nearest edge of the respective major surface 6 is half the distance between two neighboring sockets. This renders it possible to stack the building blocks 1 in staggered formation in a manner as shown in FIG. 9, i.e., that the building blocks of each course are offset with respect to the building blocks forming the neighboring course or courses. A single connector 2 can suffice to establish a satisfactory connection between two neighboring building blocks 1; however, it is clear that two or more connectors 2 can be used between each pair of neighboring building blocks. The number of connectors 2 also depends on the extent to which two neighboring building blocks overlap each other. When a course is assembled, a requisite or a randomly selected number of connectors 2 can be placed onto the exposed major surfaces 6 of the building blocks forming the just completed course, and the connectors are distributed by rolling them into selected or random sockets 3. The next course is then assembled by laying the building blocks (with a desired degree of lateral offset) onto the blocks of the completed course.

The joints 5 between neighboring building blocks are filled with mortar, glue, concrete or other suitable bonding material.

It is also within the purview of the invention to provide sockets 3 in the narrower sides or surfaces 6*a* or 6*b* of the building blocks 1. This depends on the manner in which the building blocks are to be stacked to form a masonwork, i.e., on the desired thickness of masonwork. As a rule, the sockets 3 will be provided only in the two major surfaces 6 of each building block.

Each socket 3 is bounded by a hemispherical surface. When using building blocks 1 of average size, it suffices to provide each major surface 6 with eight suitably distributed or arrayed sockets 3. The distance between each pair of neighboring sockets 3 (in a longitudinally or transversely extending row of sockets) is the same and, as mentioned above, this distance is twice the distance between a socket 3 and the nearest edge of the respective surface 6. Such distribution and spacing of sockets 3 enables the workmen to assemble a large number of different patterns of building blocks. The registering sockets 3 in the surfaces 6 of two neighboring building blocks (see FIG. 2) are preferably mirror symmetrical to each other.

The diameters of the connectors 2 are such that each thereof can be readily received in two registering sockets 3. If desired, a coat 7 of suitable adhesive or binder can be provided to surround a properly inserted connector. Alternatively, the sockets 3 can be dimensioned in such a way that they receive the connectors 2 with negligible play. The inserted connectors 2 are positioned with a view to insure that a portion of maximum cross-sectional area of each connector is located in the common plane of the neighboring major surfaces 6; this is clearly shown in FIG. 2. If a coating 7 is used, its thickness preferably equals or approximates the width of joints 5 between neighboring building blocks 1.

Connectors in the form of spheres have been found to be especially suited for use in combination with the building blocks of the present invention. Such connectors need not be oriented prior to insertion into the sockets 3, i.e., they can be simply rolled toward and into the sockets and each thereof automatically assumes an optimum position in which it fills or practically fills the respective socket. Moreover, the ratio of diameter to volume of a spherical connector is especially satisfactory by insuring a pronounced resistance to lateral shifting of neighboring building blocks 1 with respect to each other. Still further, spherical connectors can be manufactured at a low cost in conventional machinery and are less likely to chip or undergo pronounced deformation than plug-shaped, brick-shaped or cube-like connectors. Thus, dents or like deformations of the exposed surface of a spherical connector do not affect its utility in a masonwork which is assembled of building blocks embodying the present invention. In most instances, a connector 2 (with or without a coat 7) will lie flush or nearly flush against the hemispherical surfaces bounding the neighboring sockets 3 so that such connector will offer a highly satisfactory resistance to lateral shifting of the adjacent building blocks. This insures that the pressure against each unit area of the exposed surface of the connector is low. However, spherical connectors can be used with advantage even if their diameters deviate considerably from the diameters of open ends of the sockets 3, i.e., if the connectors are received with substantial play. Still further, the surfaces bounding the sockets need not be smooth, i.e., they can exhibit roughnesses in the form of spaced-apart projections whose tips contact the external surface of a properly inserted spherical connector. This suffices to insure adequate resistance against lateral shifting of neighboring building blocks with respect to each other, mainly because a portion of maximum cross-sectional area of each connector is located in the plane of the respective joint 5.

In order to assemble a masonwork, a first course of building blocks 1 is laid on a foundation and the upper sides (and, if necessary, the gaps between neighboring building blocks of such course) are coated with a suitable bonding agent, e.g., an adhesive. The undersides of building blocks which are to form the second course may but need not be coated prior to placing them onto the building blocks of the first course. Such placing of the building blocks of the second course onto the first course takes place subsequent to insertion of a requisite number of spherical connectors 2 into the exposed sockets 3 at the upper sides of building blocks forming the lower course. If the workmen do not desire to insert a connector 2 into each and every exposed socket 3 of the building blocks forming the lower course, or if the workers are instructed to use a relatively small number of connectors, the connectors are preferably placed close to the ends of each building block in the lower course. The extent to which the building blocks of the upper course are staggered with respect to the building blocks of the lower course depends on the desired pattern of the masonwork and on the number of connectors between each pair of overlapping building blocks. The workers thereupon coat the upper sides of building blocks forming the uppermost course, insert a requisite number of connectors into the exposed sockets of such building blocks, and proceed with the laying of blocks which are to form the next-higher course.

It is clear that spherical connectors constitute but one form of devices which can be employed to prevent lateral shifting of building blocks in neighboring courses. For example, one can resort to prismatic, cube-shaped, plug-shaped or otherwise configurated smooth-surfaced or facetted connectors. However, this necessitates the making of modified sockets, i.e., each socket should have a configuration which is complementary to one-half of the connector. Spherical connectors are preferred at this time for reasons which were outlined above, especially lower cost, convenience of manufacture, a high diameter-to-volume ratio, convenience of insertion into hemispherical or similar sockets and greater resistance to chipping, cracking and/or other damage. For example, a prismatic connector must be properly oriented prior to insertion into a complementary socket and the surfaces bounding the socket, as well as the external surfaces of the prismatic connector, must be machined or otherwise finished with a relatively high degree of precision. Furthermore, the edges and corners of prismatic or like facetted connectors are likely to break and to drop into the sockets therebelow so that the fragments prevent proper insertion of prismatic connectors. In many instances, a prismatic or like connector must be forcibly inserted into the corresponding sockets; this does not present too many problems when a connector must be forcibly inserted into a socket in the exposed upper side of a building block; however, the insertion is much more difficult when the upper half of such connector must be forced into a socket at the underside of a building block.

The material of the joints 5 protects properly inserted connectors 2 against excessive stresses, i.e., the material which is used in the joints bonds neighboring building blocks to each other so that the connectors need not resist lateral shifting of neighboring building blocks after the material of the joints 5 is allowed to set. Therefore, the connectors serve primarily as a means for insuring adequate alignment of building blocks during assembly of a masonwork. This, in turn, renders it possible make the connectors of a relatively inexpensive material which need not exhibit a pronounced resistance to deformation. Many synthetic plastic substances are suited for the manufacture of spherical connectors, especially those which exhibit a satisfactory or pronounced resistance to wear. This simplifies the transport of connectors to the locale of use (e.g., in sacks) because the connectors need not be treated gently. Other materials which can be used for the manufacture of connectors are materials of which the building blocks are made, wood, metal and many others.

Figure 3:
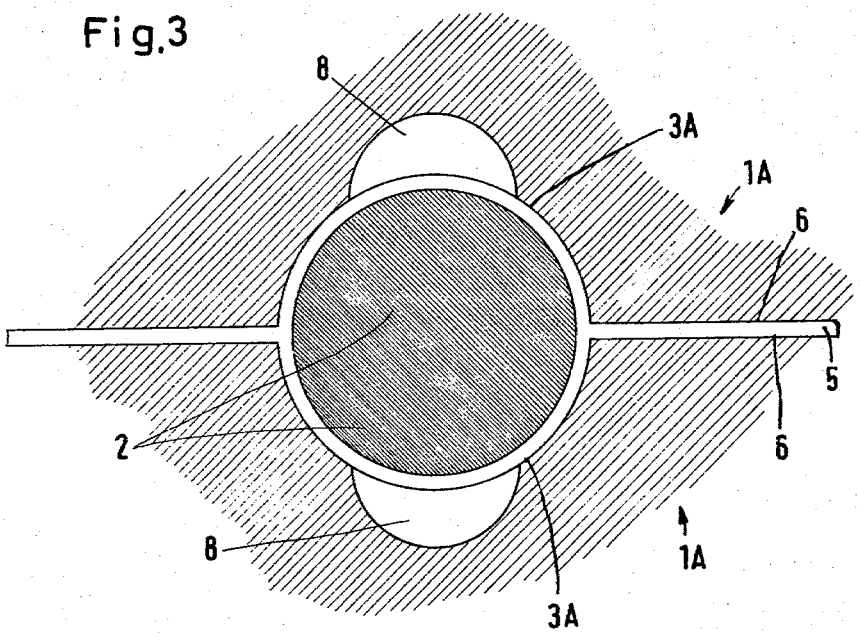
FIG. 3 is a similar fragmentary vertical sectional view of two modified building blocks with a spherical connector therebetween.

FIG. 3 shows that the sockets 3A in the surfaces of building blocks 1A need not be exactly spherical, i.e., each of these sockets may be formed with one or more unfilled portions or extensions 8 of substantially semicircular outline which allow for accumulation of dust, fragments of building blocks or other foreign matter. This, in turn, insures that such foreign matter cannot interfere with proper insertion of spherical connectors 2 into the registering sockets 3A. As a rule, foreign matter which accumulates in the unfilled portions or extensions 8 will consist of particles of building blocks which are separated from the exposed surfaces of building blocks during transport to the locale of use and/or during handling at such locale. In many instances, removal of all traces of foreign matter from the sockets is costlier and more time-consuming than the provision of extensions 8. As a rule, the extensions will communicate with the deepmost portions of the respective sockets; this insures that foreign matter descends into such extensions by gravity, at least in the upper surfaces of building blocks. The area of openings between the extensions 8 and the filled portions of the respective sockets 3A is relatively small, i.e., the provision of such extensions does not unduly affect the accuracy with which a connector 2 fits into the sockets 3A.

Figure 4:
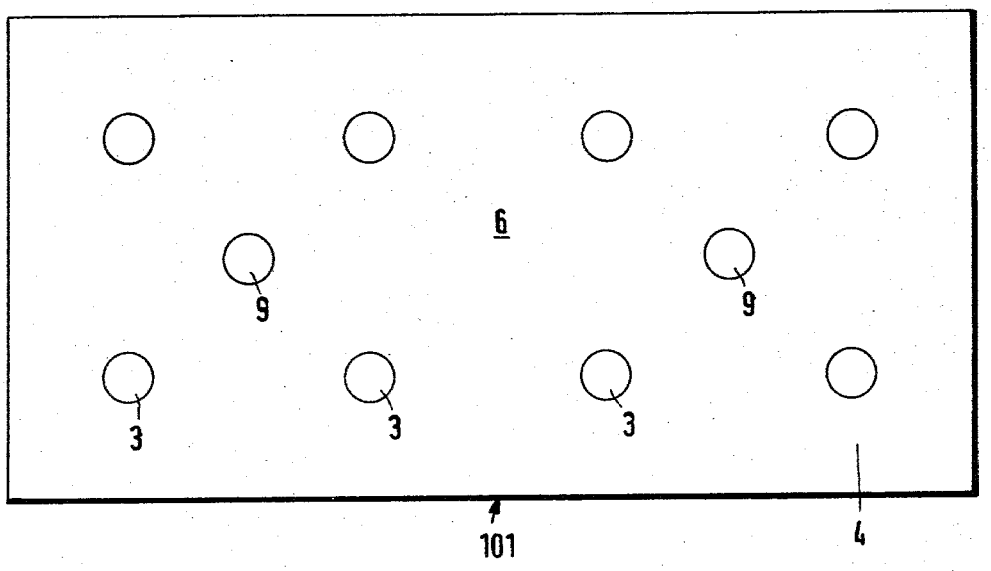
FIG. 4 is a plan view of a third building block.
Figure 5:
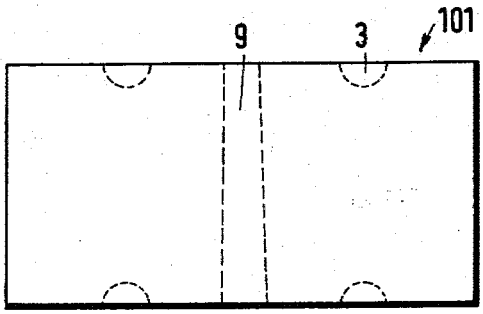
FIG. 5 is a side elevational view of the third building block as seen from the right-hand side of FIG. 4.
Figure 6:
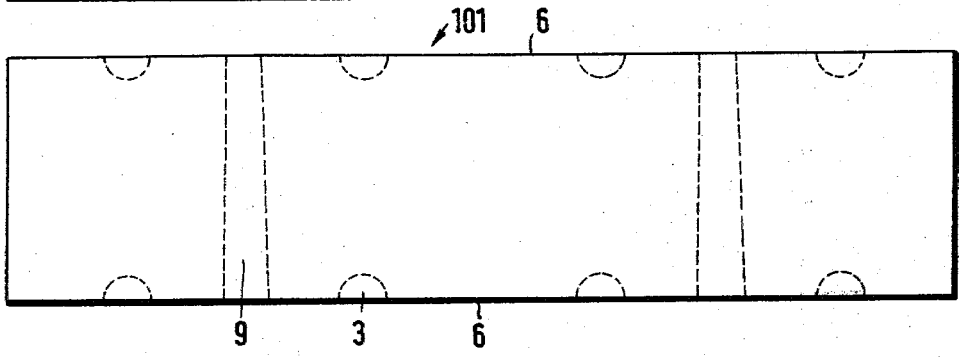
FIG. 6 is a side elevational view of the third building block as seen from the top of FIG. 4.
Figure 7:
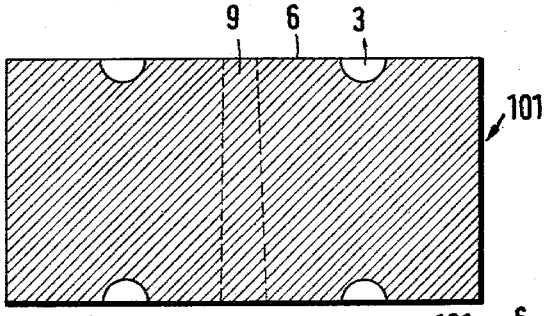
FIG. 7 is a transverse vertical sectional view of the building block shown in FIG. 4.
Figure 8:
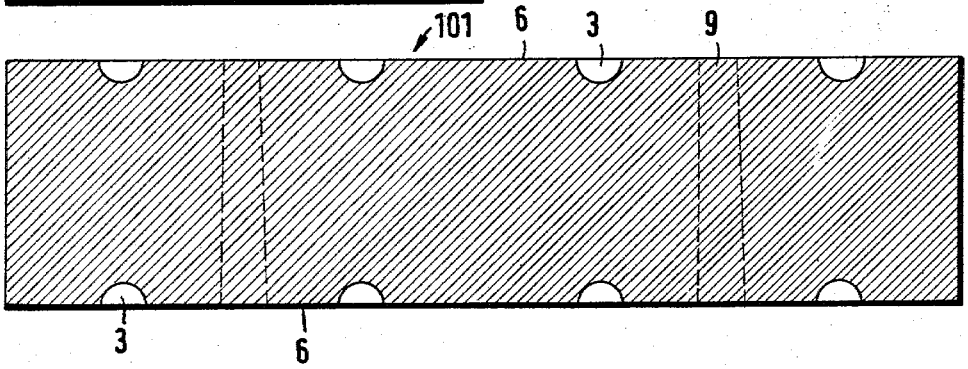
FIG. 8 is a longitudinal vertical sectional view of the building block shown in FIG. 4.

FIGS. 4 to 9 show that each building block 101 can be provided with one or more through holes or bores 9 for the passage of electric cables, pipes, reinforcing rods or the like. It is preferred to provide the blocks 101 with holes 9 which extend between the two major surfaces 6 and taper in a direction from the one toward the other major surface. It is further preferred to locate each hole 9 in the center between four neighboring sockets 3. Thus, if each major surface 6 of a building block 101 has eight sockets 3, such building block will be provided with two holes 9 which are positioned in a manner as best shown in FIG. 4. The axes of the two holes 9 of FIG. 4 are located in a plane which is disposed midway between the two rows of four sockets 3 each.

The provision of holes 9 which are bounded by conical surfaces is desirable and advantageous because the building blocks can be readily withdrawn from their molds. Moreover, the cores which are used in the molds to form the holes 9 are more likely to become separated from the surfaces bounding the respective holes. FIG. 9 shows that, when the building blocks 101 are assembled into a masonwork consisting of several superimposed courses, the larger-diameter end of the hole 9 in a building block of one course is adjacent to the smaller-diameter end of the hole 9 in the nearest building block of the neighboring course. It will be readily seen that a pipe, a cable or a rod can be easily introduced from below because such part enters the larger-diameter lower end of each hole. If a pipe, cable or rod is to be introduced from above, the building blocks 101 are inverted so that the larger-diameter ends of their holes 9 are located in the region of the upper major surfaces 6.

Figure 10:
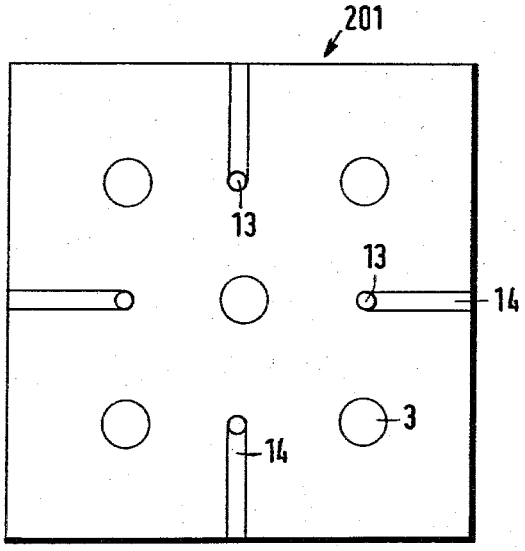
FIG. 10 is a plan view of a fourth building block.
Figure 10A:
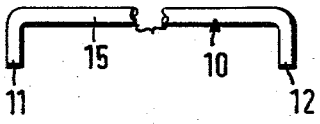
FIG. 10*a* is a fragmentary elevational view of an auxiliary connector for building blocks of the type shown in FIG. 10.
Figure 11:
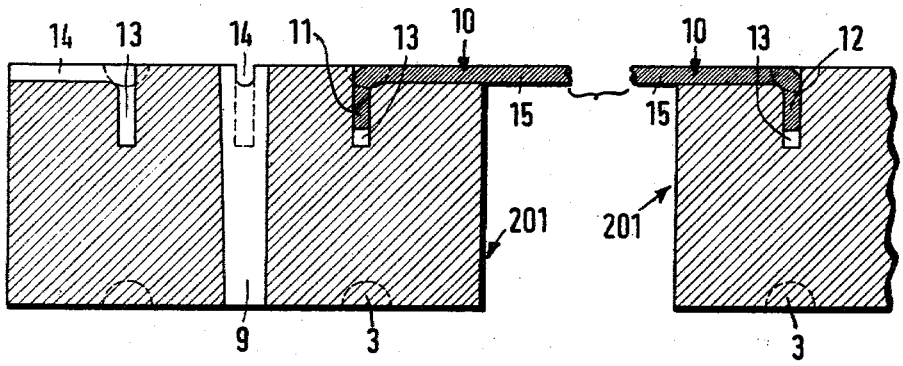
FIG. 11 is an exploded sectional view of two building blocks of the type shown in FIG. 10 and of an auxiliary connector in operative position.

FIGS. 10, 10*a* and 11 show modified building blocks 201 which have auxiliary sockets 13, 14 for auxiliary connectors 10. Each auxiliary connector 10 is a U-shaped wire or rod whose legs 11, 12 are receivable in blind bores 13 and whose web 15 is receivable in the channels 14 of the neighboring building blocks 201. Each blind bore 13 constitutes with the respective channel 14 an auxiliary socket for one-half of an auxiliary connector 10. The blind bores 13 are parallel to the bore or hole 9 and alternate with the four sockets 3 in the respective major surface 6 of the building block 201. The legs 11 and 12 can extend into the respective blind bores 13 with minimal or reasonable tolerance. The longitudinal direction of each channel 14 is preferably normal to the adjacent lateral side of the building block 201. The combined length of two channels 14 equals the length of a web 15; this insures that an auxiliary connector 10 can be readily inserted into the blind bores 13 and channels 14 of two neighboring building blocks 201 forming part of one and the same course.

It is clear that the auxiliary connectors 10, or analogous auxiliary connectors, can be used with equal advantage to establish connections between superimposed building blocks 201. To this end, the auxiliary sockets 13, 14 are provided in the lateral sides of the building blocks 201. It is preferred to provide two spaced-apart auxiliary connectors for each pair of neighboring building blocks 201, i.e., a second auxiliary connector will be provided to couple the lower portions of the building blocks 201 of FIG. 11 to each other.

The right-hand building block 201 of FIG. 11 can be said to constitute a third building block which is coupled to the left-hand building block 201 by one or more auxiliary connectors. These building blocks form part of one and the same course. Additional courses are assumed to be provided above and/or below such course. Each auxiliary socket 13, 14 has a central symmetry plane which includes the axis of the through hole 9.

FIGS. 12, 13, 13*a* and 13*b* show modified auxiliary connectors 110 whose end portions 16 are designed to fit into the sockets 3 of the building blocks 301. The webs 17 of the auxiliary connectors 110 are flat and extend into shallow channels 18 of the building blocks 301. An advantage of such auxiliary connectors is that the building blocks 301 can be produced in simpler presses because the blind bores 13 of FIGS. 10 and 11 can be dispensed with.

Figure 12:
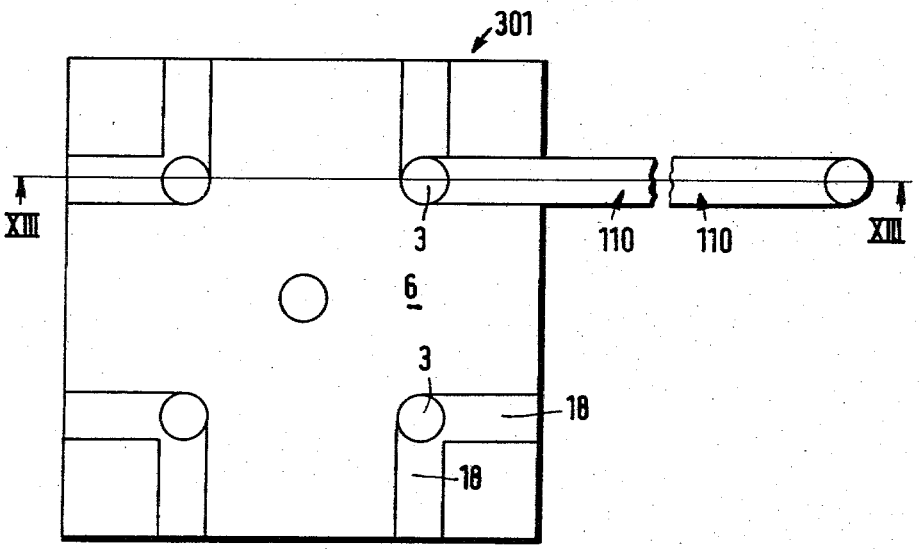
FIG. 12 is a plan view of a modified building block and a fragmentary plan view of a modified auxiliary connector.

The auxiliary connectors may consist of metallic, synthetic plastic or other suitable material. For example, the webs 17 of the auxiliary connectors 110 may consist of steel. FIG. 12 shows that each major surface 6 of the building block 301 can be provided with four pairs of shallow channels 18, one pair for each socket 3. This renders it possible to use auxiliary connectors 110 for attachment of blocks 301 which are disposed side-by-side or one above the other, as viewed in FIG. 12. The longitudinal direction of each channel 18 extends at right angles to the nearest edge of the corresponding major surface 6 of the building block 301. As mentioned above, it is preferred to use at least two auxiliary connectors 10 or 110 for each pair of neighboring building blocks 201 or 301. This results in more uniform distribution of pressures when the building blocks are stacked or otherwise arrayed to constitute a masonwork. The legs 11, 12 or the end portions 16 are preferably pressed fully into the respective portions of auxiliary sockets 13, 14 or into the sockets 3 to insure that they will adhere to the adjacent building blocks (especially in the case of the legs 11 and 12). When the next course is laid, the building blocks which rest on the auxiliary connectors complete the introduction of legs 11, 12 or end portions 16 into the corresponding portions of the respective auxiliary sockets or into the sockets 3. If the auxiliary connectors are coated with adhesive, and/or if the surfaces bounding the associated auxiliary sockets or sockets 3 (FIGS. 12 and 13) are coated with adhesive, the bonds between the auxiliary connectors and the building blocks 201 or 301 become permanent as soon as the material of the adhesive sets.

Figure 18:
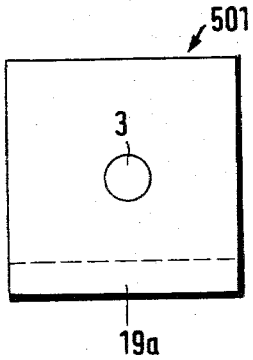
FIG. 18 is a plan view of a miniature building block with a lateral groove.
Figure 19:
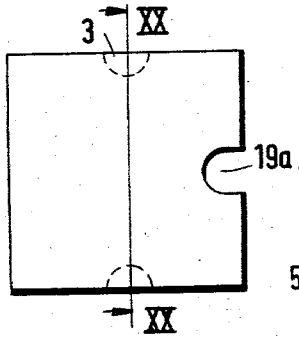
FIG. 19 is a view as seen from the left-hand side of FIG. 18.
Figure 20:
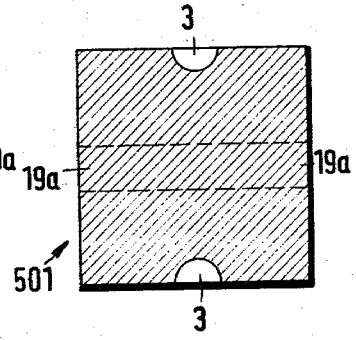
FIG. 20 is a sectional view as seen from the line XX—XX of FIG. 19.
Figure 21:
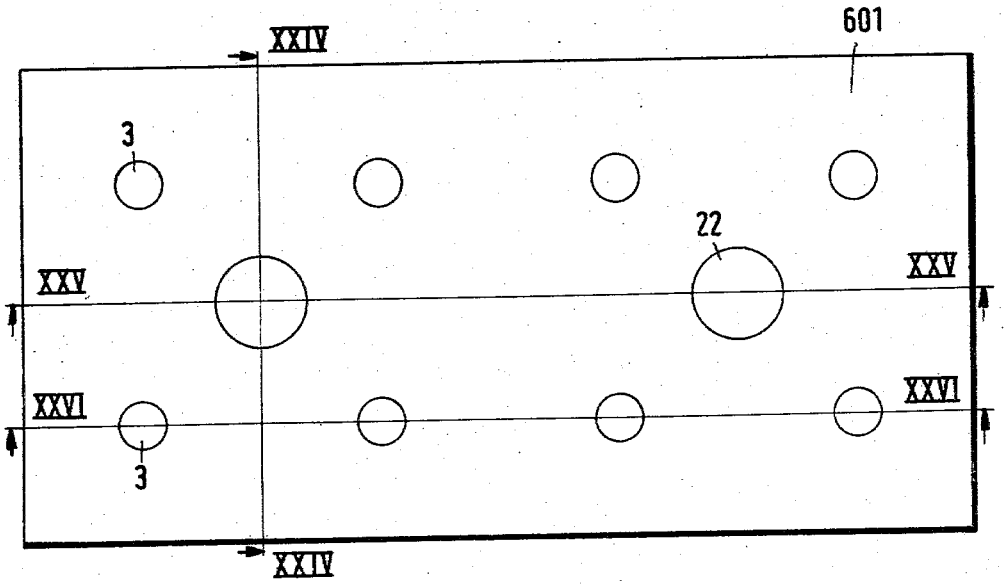
FIG. 21 is a top plan view of an additional building block.
Figure 25:
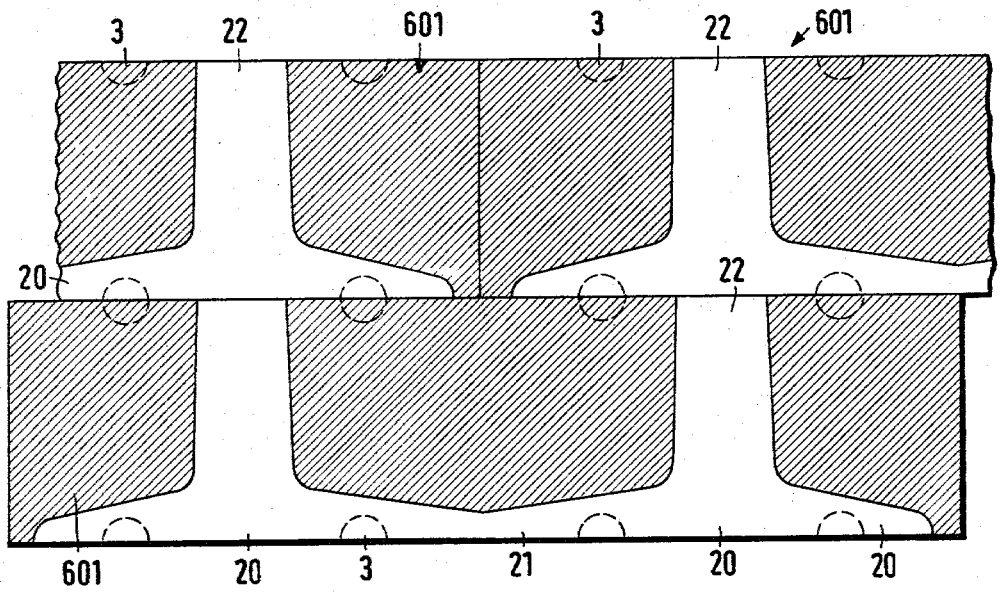
FIG. 25 is a sectional view as seen in the direction of arrows from the line XXV—XXV of FIG. 21.
Figure 26:
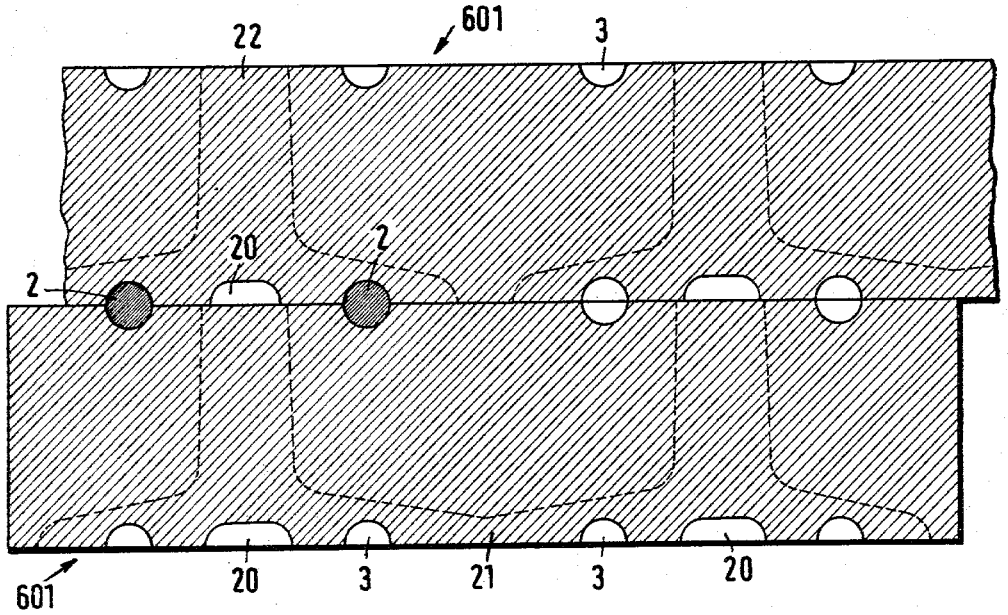
FIG. 26 is a sectional view as seen in the direction of arrows from the line XXVI—XXVI of FIG. 21.

FIGS. 14 to 17 show that, in addition to or instead of the holes 9, the building blocks 401 can be provided with elongated grooves 19 which serve the same purpose as the holes 9. Thus, two grooves 19 together form a composite hole for the laying of cables, pipes, rods or analogous elongated objects. FIG. 14 shows that the groove 19 intersects the holes 9; this renders it possible to guide a cable from a hole 9 into a groove 19 or vice versa. It is clear that the lateral sides of the blocks 401 can also be provided with grooves corresponding to those denoted by the characters 19; this allows for the laying of cables or the like between the sides of two neighboring building blocks. Lateral grooves 19*a* are shown in the cube-shaped miniature building block 501 of FIGS. 18 to 20.

Referring to FIGS. 21 to 26, the building blocks 601 therein shown are provided with relatively large depressions or recesses each of which has two mirror symmetrical star-shaped halves 20 which meet at the locus 21. These recesses are filled with mortar or other bonding material to establish highly reliable connections between superimposed building blocks. The prongs of each half 20 of a recess alternate with the sockets 3 in the respective major surface 6 of the building block 601 (see particularly FIG. 22). When the recesses are filled with bonding material, the latter adheres to the major surface of the adjacent building block 601 and establishes a very strong and reliable bond between such building blocks (see FIGS. 25 and 26).

The central portion of each half 20 of a recess preferably constitutes a funnel-shaped inlet 22 for admission of bonding material. The inlets 22 of adjacent (superimposed) blocks 601 register with each other to allow for admission of bonding material into several recesses at a time. The bonding material is readily flowable so that it completely fills the recesses of superimposed blocks 601. It will be noted that the inlets 22 are disposed in the same way as the holes 9, i.e., each such inlet 22 is located in the center between four neighboring sockets 3. The connectors 2 are inserted into the respective sockets 3 prior to pouring of bonding material which is to fill the recesses 22. This insures that the blocks 601 are properly stacked prior to bonding to each other. If the bonding material is poured simultaneously into a large number of superimposed building blocks 601, it completely fills the recesses by gravity as well as under the weight of the bonding material thereabove. This insures the formation of highly satisfactory connections between superimposed building blocks 601. The bonding material may be low-viscosity mortar, tar, certain types of soil (such as mud or clay), plastic adhesive and/or others.

The inlets 22 may further serve for introduction of rod-shaped reinforcing elements prior to pouring of bonding material. All that is necessary to select the diameters of the inlets 22 in such a way that the reinforcing elements are received therein with requisite clearance for admission of bonding material. The reinforcing elements may consist of steel (of the type used for reinforcing of concrete) or wood (e.g., bamboo when the building blocks 601 are used in developing countries in the equatorial region). In the latter instance, the bonding material may consist of mud or clay, i.e., a substance which is readily available in such countries.

The height of the stellate portions 20 of recesses in the building blocks 601 depends on the nature and bonding qualities of the material which is used as a filler. Thus, if the viscosity of the bonding material is relatively high and if such material is capable of furnishing a highly satisfactory bonding action, the height of star-shaped portions 20 will be less than when the bonding material requires a relatively long interval of time for complete setting (e.g., when the bonding material is low-viscosity mortar).

An important advantage of the improved building blocks and masonwork is that relatively small, lightweight, simple and inexpensive connectors suffice to insure accurate alignment of building blocks during assembly of successive courses or other configurations. The stresses which the connectors 2 must withstand during laying of building blocks are relatively small and such stresses are terminated or further reduced when the joints 5 are filled with a bonding agent and/or when the building blocks are secured to each other by one or more auxiliary connectors. When the blocks are laid upon a reasonably strong foundation, the stresses which the connectors 2 must resist are especially small. Therefore, such masonworks can employ small-diameter connectors 2 which may consist of inexpensive material exhibiting low resistance to deformation. Thus, at least in most instances, the connectors 2 merely serve to insure accurate registry of neighboring building blocks. Nevertheless, and as explained above, it is equally within the purview of the invention to employ facetted connectors which are receivable in sockets bounded by surfaces which are complementary to such facets. Plugs with tapered end portions can be used just as well; however, the resistance which the plugs offer to lateral shifting of building blocks is normally much too high to justify their use in a masonwork. Plugs or other types of connectors whose configuration deviates from that of a sphere can be utilized when the masonwork is to be erected on sand or muddy terrain, i.e., not on a solid foundation.

Since the connectors are simple and inexpensive, they need not be manipulated and/or stored with great care. Thus, it can be left to the workman's discretion to utilize a larger or smaller number of connectors, and losses of one or more connectors at the locale of use, e.g., at the site of a building construction, due to negligence of workmen do not affect the overall cost of the masonwork. As a rule, the forces which tend to shift neighboring building blocks with respect to each other are most pronounced in the planes of abutting major surfaces of two adjacent building blocks. Such forces can be readily taken up by spherical connectors whose portions of maximum cross section lie in such planes. It has been found that stresses on other portions of the connectors are negligible; therefore, it is not necessary to insure that each half of a spherical connector is in full surface-to-surface contact with the adjacent building block.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. In a masonwork, a combination comprising a first and a superimposed second building block, said blocks having neighboring surfaces at least one of which has a recess, and registering sockets in said surfaces; a substantially spherical connector having first and second substantially hemispherical sections which are respectively complementary to and are received in the sockets of said first and second blocks, the weight of said second block being taken up by the surface of said first block; a substantially funnel-shaped inlet in the building block including said one surface for admission of bonding agent into said recess, said inlet extending from said recess to that surface of the respective block which is located opposite said one surface; and hardenable bonding agent filling said recess.

2. A combination as defined in claim 1, wherein said sockets of said one surface form an array of sockets around said inlet.

3. A combination as defined in claim 1, wherein said inlet and the sockets of the respective block constitute an array whose components form a predetermined pattern.

4. A combination as defined in claim 1, wherein the cross-sectional area of said inlet is sufficiently large to allow for insertion of at least one elongated reinforcing element which is embedded in said agent after filling of said recess.

5. A combination as defined in claim 1, wherein the depth of at least a portion of said recess is a function of the characteristics of said bonding agent.

6. In a masonwork, a combination comprising a first and a superimposed second building block, said blocks having neighboring surfaces which have registering grooves together defining a hole for the insertion of cables or the like, and registering sockets, said blocks further having registering through holes which intersect the hole defined by said grooves; and a substantially spherical connector having first and second substantially hemispherical sections which are respectively complementary to and are received in the sockets of said first and second blocks, the weight of said second block being taken up by the surface of said first block.

7. In a masonwork, a combination comprising a first and a superimposed second building block, said blocks having neighboring surfaces at least one of which has a recess including at least one substantially star-shaped portion, and registering sockets in said surfaces; hardenable bonding agent filling said recess; and a substantially spherical connector having first and second substantially hemispherical sections which are respectively complementary to and are received in the sockets of said first and second blocks, the weight of said second block being taken up by the surface of said first block.

8. A combination as defined in claim 7, wherein said recess further includes an additional star-shaped portion, said star-shaped portions having respective prongs and one prong of said star-shaped portion being in communication with a prong of said additional star-shaped portion.

9. In a masonwork, a combination comprising a first and a superimposed second building block, said blocks having neighboring surfaces and registering sockets in said surfaces; a substantially spherical connector having first and second substantially hemispherical sections which are respectively complementary to and are received in the sockets of said first and second blocks; and means for defining at least in said first block a debris-collecting extension which opens onto a surface of the respective block that bounds the respective socket and is juxtaposed with the respective section of said connector in the assembled condition.

10. A combination as defined in claim 9, wherein at least one of said blocks has a second surface and an elongated open-ended groove in said second surface.

11. A combination as defined in claim 9, wherein at least one of said surfaces has a recess and further comprising a hardenable bonding agent filling said recess.

12. A combination as defined in claim 9, wherein said connector fills only a portion of at least one of said sockets.

13. A combination as defined in claim 12, wherein the unfilled portions of said sockets have a substantially semicircular outline.

14. A combination as defined in claim 9, wherein said blocks have registering through holes for cables or the like.

15. A combination as defined in claim 14, wherein the sockets in said surfaces and said holes constitute an array whose components form a predetermined pattern.

16. A combination as defined in claim 9, further comprising a third building block adjacent to said first building block, said first and third blocks having auxiliary sockets and further comprising an auxiliary connector having portions extending into the auxiliary sockets of said first and third building blocks.

17. A combination as defined in claim 16, wherein said first block has a through hole for the laying of cables or the like and said auxiliary socket of said first block has a central symmetry plane including the axis of said hole.

18. A combination as defined in claim 9, wherein said surfaces have registering grooves together defining a hole for the insertion of cables or the like.

19. A combination as defined in claim 18, wherein said grooves are disposed substantially centrally of the surfaces of said building blocks.

20. A combination as defined in claim 9, further comprising a third building block adjacent to said first block and an auxiliary connector having end portions received in the sockets of said first and third building blocks.

21. A combination as defined in claim 20, wherein said auxiliary connector further includes a flat median portion recessed into said first and third blocks.

22. A combination as defined in claim 20, wherein said end portions are hemispheres and said sockets for said end portions are bounded by complementary hemispherical surfaces.

23. A combination as defined in claim 20, wherein said first and third blocks have registering shallow channels and said auxiliary connector comprises a flat median portion received in said channels.

24. A combination as defined in claim 23, wherein the longitudinal directions of said channels are at least substantially normal to that edge of said surface of said first block which is adjacent to said third block.

* * * * *